United States Patent [19]

Mizuno et al.

[11] 4,011,993

[45] Mar. 15, 1977

[54] APPARATUS FOR PAINT APPLICATION

[75] Inventors: Makoto Mizuno; Yoshio Nishiumi, both of Tokyo; Yukio Nagasaka, Kawagoe, all of Japan

[73] Assignee: Atom Chemical Paint Co., Ltd., Tokyo, Japan

[22] Filed: May 27, 1975

[21] Appl. No.: 580,613

[30] Foreign Application Priority Data

Mar. 26, 1975 Japan ..... 50-039372[U]

[52] U.S. Cl. ..... 239/214; 118/308

[51] Int. Cl.[2] ..... B05B 3/02

[58] Field of Search ..... 118/DIG. 1, DIG. 16, 118/308, 305; 239/214, 220, 222; 222/414, 410

[56] References Cited

UNITED STATES PATENTS

| | | | |
|---|---|---|---|
| 2,321,082 | 6/1943 | Harshberger | 118/308 X |
| 2,352,749 | 7/1944 | Wills | 239/222 X |
| 2,523,642 | 9/1950 | Becker | 222/414 X |

FOREIGN PATENTS OR APPLICATIONS

| | | | |
|---|---|---|---|
| 842,730 | 7/1960 | United Kingdom | 239/222 |

*Primary Examiner*—John P. McIntosh

*Attorney, Agent, or Firm*—Woodhams, Blanchard and Flynn

[57] ABSTRACT

An apparatus which is used for paint application to a road surface comprises a paint supply means provided with a valve means rotatably fitted in a bore-like space which is formed longitudinally in the body of the supply means, a plurality of orifices in two rows in an opposite relation on a lower portion of said paint supply means for paint discharging, a pair of rollers each provided on the external periphery thereof and in the axial direction of the roller with a vast plurality of projecting teeth and grooves formed side by side with the projecting teeth, said rollers being attached to said paint supply means to rotate inwardly and disposed adjacent said orifices, and a pair of cover members each adapted to cover one of the rollers. With the arrangement mentioned above, the paint having a high viscosity can be discharged sufficiently and effectively to draw or produce lines which have a fixed width and thickness of paint on the road surface without regard to the rise and fall of the road surface.

3 Claims, 3 Drawing Figures

APPARATUS FOR PAINT APPLICATION

FIELD OF THE INVENTION

This invention relates to an apparatus for paint application which is used to draw center lines and other signs such as zebra crossings on the road surface for traffic control.

BACKGROUND OF THE INVENTION

Various kinds of devices have been proposed for drawing the center lines and other signs on the road surface. However, none of the conventional devices satisfies those requirements such as (1) a capability to draw lines having a fixed width and thickness of paint all through the lines, (2) a reliability of paint adhesion to the road surface, and (3) simplicity in the structure of the devices. In addition, with the conventional devices, it is difficult to apply a paint having a high viscosity onto the road surface. Further, the paint lines produced using a conventional air spray type device have such disadvantages as shown in FIGS. 1 and 2. In FIG. 1 the line has a portion *a* in which the paint is more thickly accumulated than in the other portions including side end portions *b* which look like a tail. In FIG. 2, the line also has a portion *a* in which the paint is more thickly accumulated than in the other portions including portions *c* in which the paint is thinly applied so that the edge portions of the line are not clear. It is therefore difficult to obtain a clear and uniform line on the road surface.

In order to overcome the above mentioned disadvantages, there has been filed U.S. patent application Ser. No. 538,966, filed Jan. 6, 1975, now U.S. Pat. No. 3,960,326, which has been assigned to the same assignee as that of this application. The apparatus of the U.S. patent application Ser. No. 538,966 now U.S. Pat. No. 3,960,326 comprises a paint supply means incorporating therein a valve means and provided with a plurality of orifices in two rows in an opposite relation on a lower portion of said paint supply means for paint discharging, a tank communicating with said paint supply means for containing a paint, and a pair of wire roll brushes attached to said paint supply means to rotate inwardly and touch said orifices.

The present invention is concerned with the improvement of the apparatus of the U.S. patent application Ser. No. 538,966. According to the present invention, the improvements in efficiency and durability can be attained. For example, in the present invention, there are employed in place of the wire roller brushes of the copending patent application Ser. No. 538,966 a pair of roller members each provided at the external periphery thereof with a plurality of projections having shapes like saw teeth in cross section, whereby the paint having a high viscosity can be discharged sufficiently and effectively.

Accordingly, an object of the present invention is to provide an apparatus for paint application including a pair of rollers each provided at the external periphery with a vast plurality of projections extending in the axial direction of the roller and having shapes like saw teeth in cross section, a plurality of orifices formed in two rows in an opposite relation on a lower portion of said supply means for paint discharging and a pair of cover members mounted on an external portion of the paint supply means, whereby the paint having a high viscosity can be discharged sufficiently and efficiently to draw the lines having a fixed width and uniform thickness without regard of the rise and fall of the road surface and the distance between the apparatus and the road surface.

Another object of the present invention is to provide an apparatus for paint application which is simple in structure and durable.

Essentially, according to the present invention, there is provided an apparatus for paint application comprising a paint supply means incorporating therein a valve means and provided, on its lower portion, with a plurality of paint discharging orifices in two rows in an opposite relation, a tank communicating with said paint supply means for containing a paint, a pair of rollers each provided at the external periphery thereof with a vast plurality of projecting teeth extending in the axial direction of the roller and grooves formed side by side with the projecting teeth, said rollers being attached to said paint supply means to rotate inwardly and located adjacent said orifices, and a pair of cover members each of which is connected at its one end to the external surface of said paint supply means to cover the roller and has, at its other end, an edge portion which is disposed adjacent the lower side of said roller.

BRIEF DESCRIPTION OF THE DRAWINGS

This invention will now be more particularly described with reference to the accompanying drawing in which.

DETAILED DESCRIPTION

Figures 1, 2, 3:
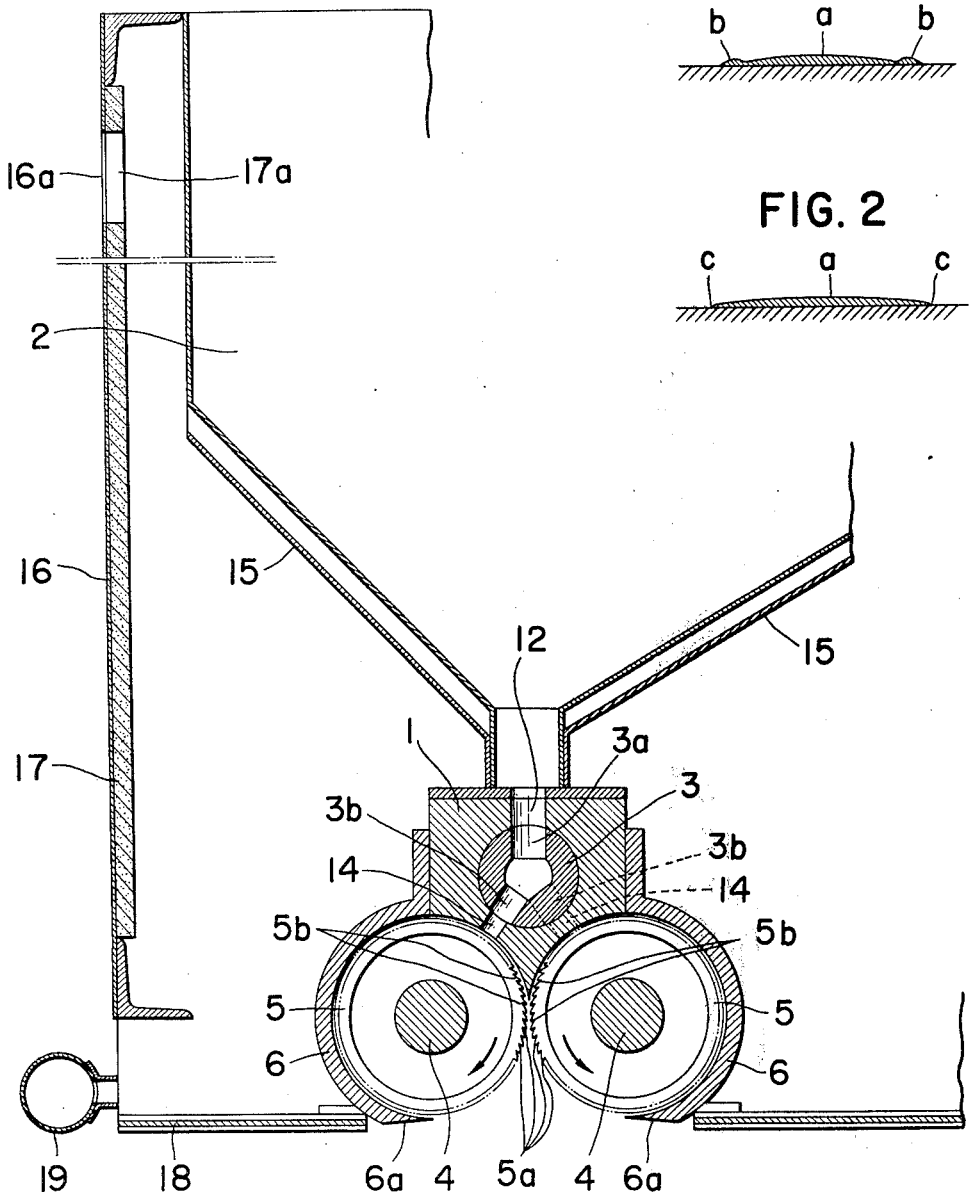
FIG. 1 is a vertical sectional view of a line drawn by a conventional apparatus.
FIG. 2 is a vertical sectional view of another line drawn by a conventional apparatus.
FIG. 3 is a vertical sectional view of an apparatus according to the present invention.

Referring now to FIG. 3, numeral 1 indicates a paint supply means carrying a paint tank 2 on the top portion thereof. Said paint supply means is further provided, on its lower portion, with a plurality of orifices 14 in two rows in an opposite relation. A roll-shaped rotation valve means 3 is provided with an upper passage **3*a* which is branched into a plurality of lower passages 3*b*. The upper passage 3*a* is adapted to communicate with a passage 12 which is formed in the paint supply means 1. The lower passages 3*b* are adapted to respectively communicate with the orifices 14. In operation, the rotation valve means 3 cooperates with the passage 12 and the orifices 14 through the upper passage 3*a* and the lower passages 3*b* to form a whole passage for paint. Said valve means 3 is rotatably fitted in a bore-like space 11 which is formed longitudinally in the body of the paint supply means 1. Numeral 4 indicates a pair of rotating shafts. Numeral 5 indicates a pair of rollers which are attached to the rotating shaft 4 with a clearance between the external periphery each of the rollers 5. The rollers are each provided at the external periphery with a vast plurality of projections 5*a* having shapes like saw teeth in cross section and extending in the axial direction of the rollers. The rollers 5 are so arranged that each of the rollers 5 is rotated in the direction as indicated by arrows in FIG. 3 by a motor (not shown) through an appropriate interlocking mechanism (not shown) at a velocity as high as, for example, more than 5,000 r.p.m. The paint supply means is arranged so that the paint is discharged onto the rollers 5 through said orifices 14. Numerals 6,6 indicate a pair of roller cover members each of which is connected at its one end to the external portion of the paint supply means 1 and provided at the other end with a sharp edge portion 6***a*. The roller cover members 6,6 are adapted to cover the rollers 5,5, respectively. In addition, numeral 15 indicates a sheltering plate for prevention of scorching of the paint. Numeral 16 indicates a casing. Numeral 17 indicates a heat insulating liner attached to the casing. An opening 16*a* of the casing 16 and an opening 17*a* of the liner constitutes a gas outlet. Numeral 18 indicates a fire preventing bottom plate. Numeral 19 indicates a burner line.

With the arrangement mentioned above, the paint having a high viscosity in the paint tank 2 is discharged from the orifices 14 passing through the passage 12 of the paint supply means 1, the upper and lower passages 3*a* and 3*b* of the valve means 3. The paint is then supplied to the serrated external peripheries of the rollers 5 and sticks to the projecting teeth 5*a* and intermediate grooves 5*b*. As described hereinabove, the rollers 5 rotates at a velocity as high as, for example, more than 5,000 r.p.m. Therefore, the paint sticking to the projecting teeth 5*a* and grooves 5*b* flows toward the top of the projecting teeth 5*a* and there the paint is atomized and delivered with high speed to the road surface.

What is claimed is:

1. An apparatus for paint application comprising a paint supply means incorporating therein a valve means and provided, on its lower portion, with a plurality of paint discharging orifices in two rows in an opposite relation, a tank communicating with said paint supply means for containing a paint, a pair of rollers each provided at the external periphery thereof with a vast plurality of projecting teeth extending in the axial direction of the roller and grooves formed side by side with the projecting teeth, said rollers being attached to said paint supply means to rotate inwardly and located adjacent said orifices, and a pair of cover members associated with said pair of rollers, each said cover member being connected at its one end to the external surface of said paint supply means to cover one of the rollers and having, at its other end, an edge portion which is disposed adjacent the lower side of the respective roller.

2. An apparatus according to claim 1, wherein said paint supply means comprises a body and a first passage having an upper end communicating with the tank and branched at its lower end, through said valve means, into a plurality of second passages communicating with the respective orifices, and valve means being positioned between said first passage and said orifices.

3. An apparatus according to claim 1, wherein said orifices are provided on the both sides of the bottom portion of said paint supply means.

* * * * *

UNITED STATES PATENT OFFICE

CERTIFICATE OF CORRECTION

Patent No. 4 011 993 Dated March 15, 1977

Inventor(s) Makoto Mizuno et al

It is certified that error appears in the above-identified patent and that said Letters Patent are hereby corrected as shown below:

Column 4, line 24; change "and valve" to ---said valve---.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*